United States Patent [19]

DeSmet

[11] Patent Number: 4,811,175

[45] Date of Patent: Mar. 7, 1989

[54] ILLUMINATED SWITCH

[76] Inventor: Gregory L. DeSmet, 365 S. Rosemead Blvd., Pasadena, Calif. 91107

[21] Appl. No.: 883,555

[22] Filed: Jul. 9, 1986

[51] Int. Cl.[4] ..... H01H 9/00

[52] U.S. Cl. ..... 362/95; 200/313; 200/314; 362/319; 362/812

[58] Field of Search ..... 362/95, 29, 251, 317, 362/319, 394, 812; 200/313, 314

[56] References Cited

U.S. PATENT DOCUMENTS

| | | | |
|---|---|---|---|
| 2,890,538 | 6/1959 | Jentges | 200/313 |
| 3,626,171 | 12/1971 | Abramowitz | 200/314 |
| 3,921,750 | 11/1975 | Shames | 340/71 |
| 4,024,368 | 5/1977 | Shattuck | 200/314 |
| 4,056,701 | 11/1977 | Weber | 200/314 |
| 4,078,257 | 3/1978 | Bagley | 200/5 R |
| 4,124,879 | 11/1978 | Schoemer | 362/26 |
| 4,163,883 | 8/1979 | Boulanger . | |
| 4,197,439 | 4/1980 | Mecklenburg | 200/314 |
| 4,207,448 | 6/1980 | Furusawa | 200/516 |
| 4,249,044 | 2/1981 | Larson | 200/5 A |
| 4,286,129 | 8/1981 | Petit | 200/513 |
| 4,293,764 | 10/1981 | Amrhein | 200/314 |
| 4,352,968 | 10/1982 | Pounds | 200/302.2 |
| 4,365,120 | 12/1982 | Pounds | 200/314 |
| 4,400,594 | 8/1983 | Serras-Paulet | 200/404 |
| 4,415,780 | 11/1983 | Daugherty | 200/306 |
| 4,421,966 | 12/1983 | Pounds | 200/5 A |
| 4,449,024 | 5/1984 | Stracener | 200/317 |
| 4,468,542 | 8/1984 | Pounds | 200/5 A |
| 4,620,075 | 10/1986 | La Belle . | |
| 4,636,593 | 1/1987 | Novak | 200/313 |

FOREIGN PATENT DOCUMENTS

| | | | |
|---|---|---|---|
| 2944304 | 5/1981 | Fed. Rep. of Germany | 200/314 |

*Primary Examiner*—Douglas Hart
*Attorney, Agent, or Firm*—Lyon & Lyon

[57] ABSTRACT

An illuminated switch, suitable for incorporation in a membrane keyboard or other microtravel switch array, is provided. By providing the switch with a translucent cover, on which symbols may be printed, and with a resilient metal spring conductor having a mesh area, light may pass through the operating mechanism of the switch. Thus, light from a source placed at the interior of the switch will pass through the switch and illuminate an area that is pressed to operate the switch.

22 Claims, 2 Drawing Sheets

ILLUMINATED SWITCH

BACKGROUND OF THE INVENTION

The field of this invention is keyboards and, more particularly, membrane keyboards. A membrane keyboard is a relatively thin switch array which is provided with a plastic membrane cover. The use of such a keyboard is considered advantageous where space is to be conserved or where it is desired to provide a sealed keyboard.

In the past there has been a desire to provide illumination for keyboards such as where an electrical device is to be used in low-light situations or where contrast is desired to be improved. Similarly, it has been desired to use illumination as an indicator of circuit operation or readiness. The desire for illumination has been partially addressed in some devices by the placement of a signalling lamp adjacent to the key site. This method, however, uses up available space on the keyboard, restricting design options. Moreover, adjacent placement of the illumination source does not increase legibility of the key.

Other means of illumination have offered lit switches which include phosphorescent and electroluminescent elements. These switches are typically quite dim and generally not independently addressable.

It has also been known to use a sheet of light-conducting material interposed between the contact mechanism and the actuating surface of a standard key. A single light source supplies light to translucent keys which are illuminated thereby.

A related device employs a hinged light-conducting material as a key actuator. The light of a lamp adjacent to the switch actuating mechanism is transmitted through the light-conducting material providing illumination of the switch area. These illuminating means are known to possess certain disadvantages. In particular, the use of such light conducting material occupies volume, restricts the use of materials which may be used in construction, and may restrict the placement of keys.

Further, the placement of light conducting material or any other light source, such as an LED, above the switch mechanism necessarily increases the thickness of the switch or keyboard.

It has also been known to provide a dome with a single hole through which a light source protrudes. This means of illumination is incompatible with some keyboards since the light source placement would interfere with the travel of the switch actuator. Further, in order to maintain the characteristic resilience and tactility of the typical dome switch, the illuminating hole must be kept small. Whether the light source protrudes or lies below the dome, the small diameter of this hole prevents illumination of a broad area.

The use of a clear, metallized, plastic dome has also been attempted. Such domes possess the drawbacks of high electrical resistance and low current tolerance. These metallized plastic domes also are not durable.

SUMMARY OF THE INVENTION

It is an object of this invention, therefore, to provide an improved illuminated keyboard. It is another object to provide a means of illuminating keys of a keyboard which provides a low profile illuminated switch. It is a further object of this invention to provide a dome switch which is illuminable and maintains the characteristic resilience, wear, and tactility desirable in membrane keyboards. It is still a further object of this invention to provide a lighted switch which is inexpensive to manufacture. Other objects of this invention include the provision of individually addressable lighting, increased legibility, low resistance, and improved current tolerance.

The present invention provides an illuminated switch. Illumination of key indicia is accomplished through a mesh spring, which comprises a solid member with a plurality of closely spaced small openings.

According to an embodiment of this invention, a translucent key actuator rests in contact with an electrically conductive dome spring. This key actuator may be a designated portion of a flexible plastic cover, and it is considered translucent if it allows light to pass through it. The dome spring is positioned over electrical contacts such that when pressure is applied to the actuator the conductive spring is forced into electrical communication with the contacts, closing the electrical circuit of the switch.

A light source is provided beneath the dome. This light source may be either a single source or an array, and it may be of any known type, such as an LED or the emitting end of a light pipe.

The dome is provided with a mesh whereby light emitted from the light source passes through the mesh holes and then through the translucent key actuator in order to provide illumination. The preferred embodiment uses a honeycomb mesh, although other arrangements are possible.

The mesh passes light while keeping the desirable mechanical characteristics of a dome switch. Moreover, it has been found that it is easier to read key indicia lit through a mesh than where the same amount of light is passed by other means.

It will be readily appreciated that this invention is applicable equally to membrane switches and to switches of other designs which employ a metal spring. Other features, applications, and advantages appear below.

DETAILED DESCRIPTION OF THE PREFERRED EMBODIMENT

Figure 1:
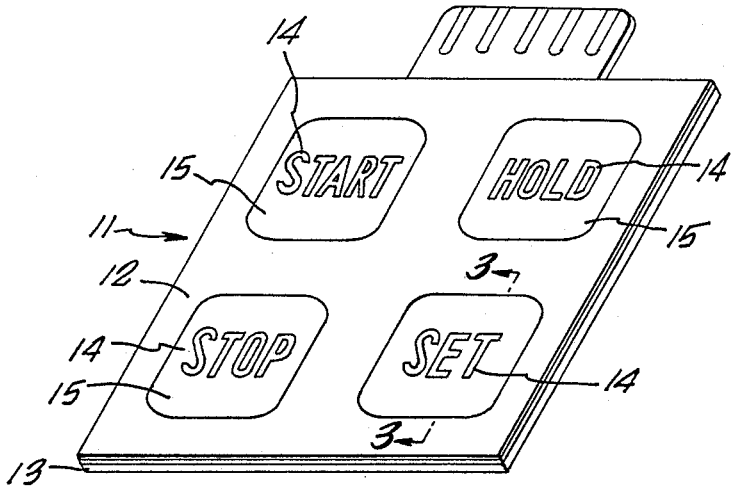
FIG. 1 is a simplified perspective view of a membrane keyboard having a plastic covering with translucent key indicia.

As can be seen from FIG. 1, a membrane keyboard 11 is provided with a plastic membrane cover 12 mounted on a substrate 13 which is typically a printed circuit board. The plastic membrane cover 12 covers a switch matrix and includes translucent portions 14 in each key site 15. The translucent portions 14 may comprise suitable symbols, letters, or numbers as indicia of the key function. The key sites 15 are often printed with a different color than the remainder of the plastic cover 12. An electrical connector 16 is provided to facilitate the carrying of electrical signals to and from other components.

Figure 2:
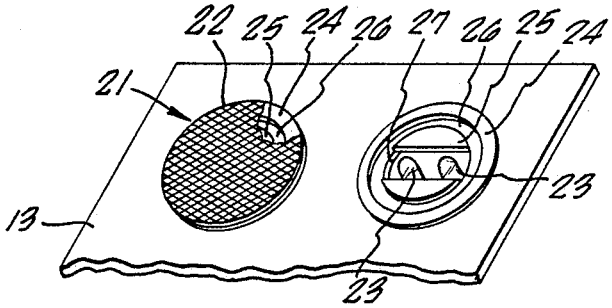
FIG. 2 is a plan view of a portion of substrate including a dome switch of the invention.

FIG. 2 shows the substrate 13 and the dome 21 of a switch used in the keyboard 11. Electrically conductive dome 21 is in the form of a spring metal mesh having holes 22 which transmit light from a light source 23. The edge of dome 21 rests on a ring electrical contact 24 which is printed on the substrate 13.

Pressure on the dome 21 causes it to flex so that its center connects with a center electrical contact 25, which is comprised of two pieces here, thereby establishing electrical continuity between the ring electrical contact 24, through the dome 21, to the center electrical contact 25, thus closing the electrical circuit. The two pads of center electrical contact 25 may be joined electrically, or they may lead to otherwise separate circuits. It will be apparent to use known means to include the switch as described herein in an electrical circuit.

The substrate 13 is typically a printed circuit board. Ring electrical contact 24 and center electrical contacts 25 are printed with a space 26 between them so that there will only be an electrical connection through the dome 21. Substrate 13 includes a cavity 27 which houses the light source 23.

The composition and dimensions of the dome 21 and contacts 24 and 25 are those ordinarily used in switches of the type to which this invention is to be adapted. Thus, the dome 21 may, in a membrane switch, comprise a dome having the same characteristics as would be used in a switch of known type, but the dome would additionally be provided with a mesh as described herein.

Figure 3:
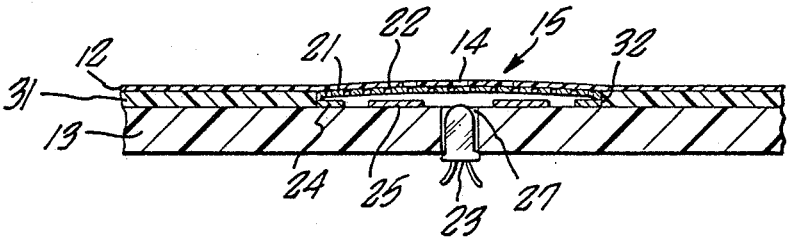
FIG. 3 is a cross-sectional view of the keyboard of FIG. 1 taken through line 3—3.

Turning now to FIG. 3, it is seen that the light source 23 is mounted beneath the dome 21 and the plastic membrane 12 such that the light from the light source 23 passes through the holes 22 in the mesh dome 21 and then through a translucent portion 14 of the plastic membrane 12. Light source 23 is preferably positioned below or flush with the center contact 25 so that it will not interfere with the operation of the dome 21. An insulating spacer 31 of known type is bonded to the substrate 13 and the cover 12. This spacer includes an opening 32 around each dome 21 thereby helping to keep each dome 21 in place.

As can be readily understood, with the provision of an independently operable light source, such as an LED 23, the highly desirable effect of independent visual annunciation is available. Depending on the circuitry associated with the keyboard, a given switch, at the option of the designer, lights up or darkens only when the indicated circuit is in operation, when the operation of that switch would be appropriate, or when the key is operated so as to provide immediate visual feedback, for example.

It will be further seen that the provision of a mesh in the dome 21 permits the introduction of a diffuse light through the translucent portion 14 of the plastic membrane 12 thus facilitating the illumination of key indicia such as words and symbols. It has been found that indicia which are illuminated through the mesh are more legible than those illuminated at the same light level, but without the mesh.

Figure 4:
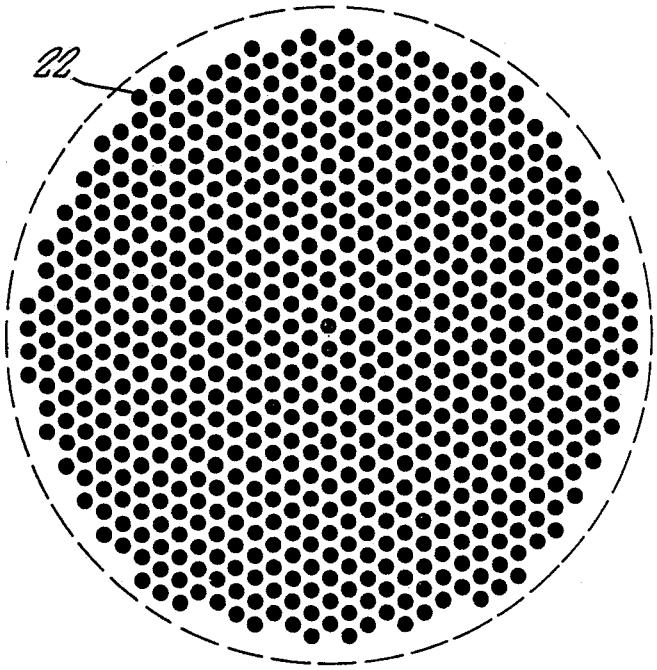
FIG. 4 is an example of a honeycomb mesh.

Many hole patterns will permit the passage of light without impairing the operation of the dome 21. It is believed that a honeycomb pattern as shown in FIG. 4 where the holes 22 occupy half the surface area of the mesh provides an optimal combination of strength and light passage. The objects of light passage and resilience may be achieved by the provision of only a portion of the dome with a mesh, but stresses in the dome may be minimized by providing the entire dome with a mesh. One may, however, provide the dome with holes in a pattern of letters or symbols where the pattern would be discernible through a translucent cover. The mesh may be formed by any of a number of means including, but not limited to, chemical etching.

The choice of a light source is largely a matter of discretion. Although the use of light emitting diodes is known to present several advantages in terms of longevity, efficiency and size, incandescent and neon lamps may also be used. Additionally, light may be conducted to the interior of the dome switch by means of fiber optic or light pipe material.

Other advantages and applications will be apparent to those skilled in the art. It is to be understood that the present invention is not limited to dome switches but may be employed with equal advantage in any switch having a resilient spring and a translucent cover.

I claim:

1. A backlit switch, comprising dome shaped springy means having a mesh area to allow substantially even passage of light.

2. A switch as in claim 1, wherein said mesh area comprises a plurality of closely spaced small openings.

3. The switch of claim 1 wherein said openings cover substantially the entire surface of said spring member.

4. The switch of claim 1 wherein said openings are formed by means of etching.

5. The switch of claim 1 wherein said openings are formed by means of stamping.

6. A switch as in claim 2, wherein said openings form a honeycomb pattern.

7. A switch as in claim 2, comprising at least six said openings.

8. A switch as in claim 1, wherein said springy means is opaque where said mesh area is not disposed.

9. A switch as in claim 1, wherein said springy means comprises a key actuator.

10. A switch as in claim 1, wherein springy means is electrically conductive.

11. A switch as in claim 1, further comprising means for providing an audible signal when said switch is triggered.

12. A switch as in claim 1, further comprising means for providing a tactile signal when said switch is triggered.

13. A switch as in claim 1, wherein a height of said switch is substantially smaller than a width of said switch.

14. A switch as in claim 1, wherein a travel distance for a key actuator is substantially smaller than a width of said switch.

15. A switch as in claim 1, wherein said switch is sealed against intrusive elements.

16. A switch as in claim 1, further comprising a gas-tight seal.

17. A switch as in claim 1, further comprising a liquid-tight seal.

18. A backlit switch, comprising translucent key actuator means;

light source means disposed to emit light to pass through said key actuator means;

electrical contact means forming a broken circuit; and dome shaped springy means for completing said broken circuit when said key actuator is triggered, said dome shaped springy means disposed between said light source means and said key actuator means, and said dome shaped springy means having a mesh area for allowing substantially even passage of light.

19. The invention of claim 18 wherein said light source comprises a light emitting diode.

20. The invention of claim 18 wherein said actuating cover is a flexible, translucent plastic sheet.

21. The invention of claim 18 wherein said actuating cover is a rigid, translucent button.

22. A backlit switch, comprising translucent key actuator means;

light source means disposed to emit light to pass through said key actuator means;

first and second electrical contact means, collectively forming a broken circuit; and dome shaped springy means for completing said broken circuit when said key actuator is triggered, said dome shaped springy means contacting said first contact means and biassed away from but contactable with said second contact means, said dome shaped springy means disposed between said light source means and said key actuator means, and said dome shaped springy means having a mesh area for allowing substantially even passage of light.

* * * * *